US005108231A

United States Patent [19]

Rausch

[11] Patent Number: 5,108,231

[45] Date of Patent: Apr. 28, 1992

[54] EMBANKMENT BLOCK

[76] Inventor: Peter Rausch, Foelz 186, A-8621 Thoerl Steiermark, Austria

[21] Appl. No.: 463,400

[22] Filed: Jan. 11, 1990

[30] Foreign Application Priority Data

Jan. 16, 1989 [AT] Austria ..... 65/89

[51] Int. Cl.[5] ..... A01G 9/02; E02D 17/20

[52] U.S. Cl. ..... 405/284; 405/286; 52/608; 47/83

[58] Field of Search ..... 52/608; 47/83; 405/284, 405/286

[56] References Cited

U.S. PATENT DOCUMENTS

| | | | |
|---|---|---|---|
| 4,190,384 | 2/1980 | Neumann | 47/83 |
| 4,521,138 | 6/1985 | Steiner . | |
| 4,524,551 | 6/1985 | Scheiwiller | 47/83 |
| 4,671,706 | 6/1987 | Giardini . | |
| 4,964,761 | 10/1990 | Rossi | 47/83 |

FOREIGN PATENT DOCUMENTS

| | | | |
|---|---|---|---|
| 0047718 | of 0000 | European Pat. Off. . | |
| 0013535 | 7/1980 | European Pat. Off. . | |
| 3040410 | 3/1982 | Fed. Rep. of Germany . | |
| 02545128 | 11/1984 | France . | |
| 2604859 | 4/1988 | France | 47/83 |
| 8503536 | 8/1985 | World Int. Prop. O. | 405/284 |
| 8503536 | 8/1985 | World Int. Prop. O. | 405/284 |

*Primary Examiner*—Henry E. Raduazo
*Attorney, Agent, or Firm*—Welsh & Katz, Ltd.

[57] ABSTRACT

In an embankment block with essentially a frame-like design for the construction of embankment structures on which plants can be planted, the front longitudinal wall (1) is shaped approximately like a shield, whereby the same projects on the top side and in longitudinal direction over the frame outlines by approximately a wall thickness.

6 Claims, 1 Drawing Sheet

EMBANKMENT BLOCK

Figure 1:
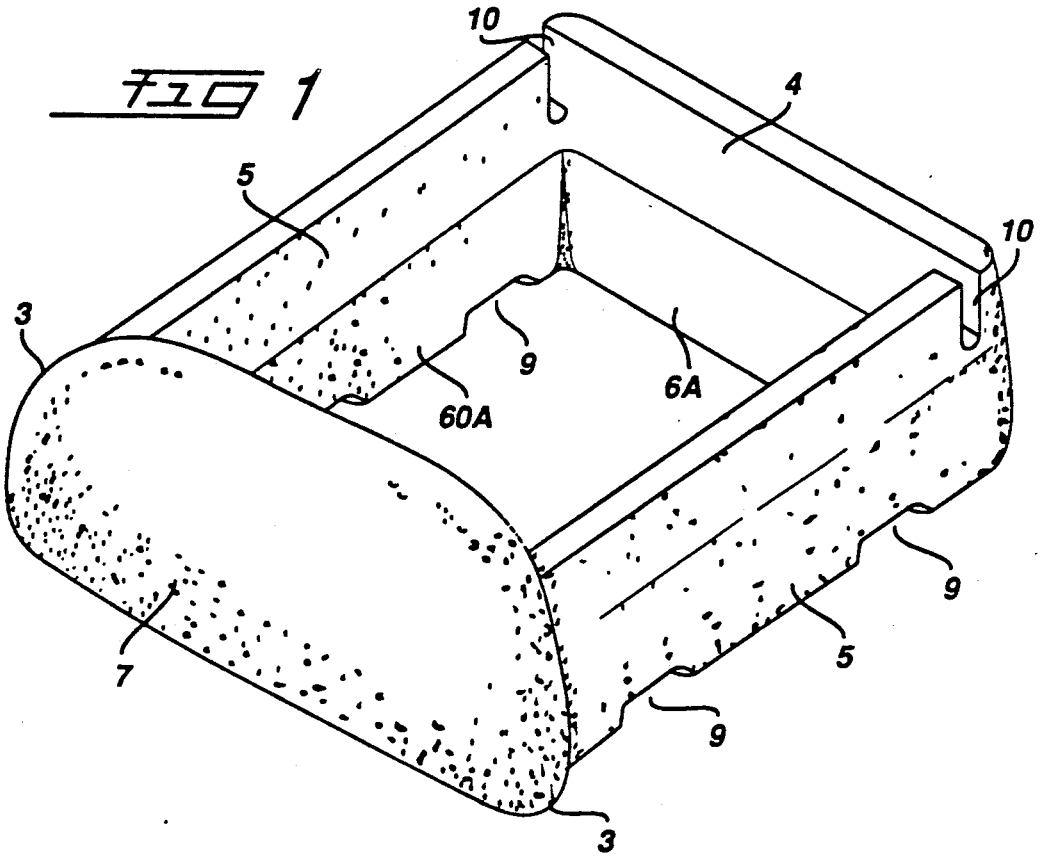

The invention relates to an embankment block with essentially a frame-like design from the construction of embankment structures on which plants can be planted.

Embankment blocks are already known with essentially a frame-like structure. Thus the trade knows an approximately box-like block, on which the invention is based. This block comprises a frame of smooth, sharp-edged walls, with the two transverse walls having a step falling backwards, which serves as a shoulder for blocks to be placed upon it. The blocks are built up in a grid-like bond and filled with earth. The gaps hereby created between the blocks free an earth embankment, allowing plants to be grown upon it.

In the known system these gaps are completely open on the front side, and the earth embankment is supported only by the front wall of the block. The plants are exposed relatively unprotected to wind, weather and solar radiation and chafe on movement on the existing sharp edges of the blocks.

Another embankment block is known from DE PS 25 37 408. This possesses an approximately bowl- to trough-like shape with bottom slab, but without rear wall.

The object of the present invention is to improve the function of such blocks and altogether to find an aesthetic solution in a technical-ecological respect, whereby manufacture should also be simple and economical.

According to the invention this problem is solved in that the front longitudinal wall is shaped approximately like a shield, whereby the same projects over the frame outline by approximately a wall thickness on the top side and in the longitudinal direction.

Through this form it is achieved that the earth slopes are supported in the gaps of an embankment advantageously by the lateral projections of the front wall of the blocks according to the invention, whereby a high stability of the wall is obtained. In addition, through these lateral projections instead of open gaps recesses are created which offer the plants protection against wind, weather and excessive solar radiation.

If in the further embodiment of the invention it is planned that the projections have curves at corners and edges, a favourable condition for plants is achieved and damage to the plants as a result of chafing is prevented. With the blocks according to the invention an aesthetic appearance of inclined structures is obtained.

The most economical way of manufacturing such blocks, however, is with stationary systems using the shake-press method. To be able to manufacture the blocks according to the invention in this process it is necessary to solve the problem of volume distribution of the building material in the moulding box during compaction. According to the invention this problem can be solved advantageously. On filling of the moulding box with the uncompacted building material, such as concrete or the like, the top edges of the—uncompacted—block lie in one plane, namely in the plane of the moulding box top side. At this point, however, it is necessary—taking uniform compaction into account—to lower the top edges of the transverse walls and of the rear wall approximately by a wall thickness compared with the top edge of the front wall. This is solved according to the invention in that the rear wall and the two transverse walls have a trapezoidal cross-section with a generally upright outside wall and a sloped inside wall which is wider towards the lower portion of each wall and whereby, if necessary, the cross-section can have two steps, with the second step occurring in the lower portion and being more markedly sloped that the first step.

The rear wall and transverse walls are thus more voluminous in the lower portion. The die can push the building material volume downwards during compaction, to a greater extent with the rear wall and transverse walls, because here in the lower area, according to the invention, more volume can be taken up.

The trapezoidal form of the rear wall and of the transverse walls, particularly in the lower area on the insides of the walls produces a further technical advantage. In embankment structures it is important that the supported soil on or in the embankment blocks finds support against slipping down. This requirement is achieved with the block according the invention not only by the projections, but also by the trapezoidal nature of the rear wall and of the transverse walls in the lower portion of the insides.

In an advantageous way the trapezoidal cross-section of the rear wall and of the two transverse walls is designed in two steps, whereby the inside wall of the greater slope lower step has a greater slope than the inside wall of the upper step.

This measure has the advantage that in this way, on filling of the embankment block with soil, the latter is compacted more intensely in the lower portion. This makes the block more stable, the soil filled in thus has a better hold, and washing-out during a heavy rainfall or on flooding is avoided.

For an easy installation it can be planned that the longitudinal projections are designed as grip ledge in dimensions and shape.

The projections are matched in dimensions and shape to the human hand grip and can thus be optimally gripped and held.

Furthermore, recesses for prongs of installation forks or the like can be provided in transverse walls on the underside, which allows an advantageous removal of the blocks from the pallet and an economical use in building in particular with blocks of a large format.

With a view to extended modes of building the embankment blocks according to the invention may also have slots on the top sides of the transverse walls in the area of the corners with the rear wall, which advantageously permits the insertion of frictionally connected anchoring bands or the like.

The following sections show, by way of example, a typical example of the invention with the aid of the drawing.

The drawing shows:

FIG. 1 Oblique view of a block designed according to experience.

Figure 2:
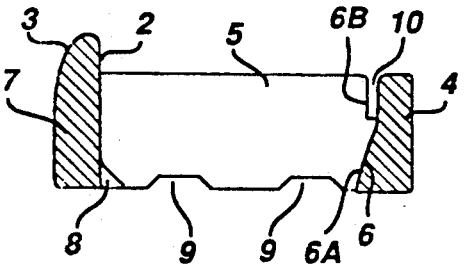

FIG. 2 Cross-section through a block according to experience.

Figure 3:
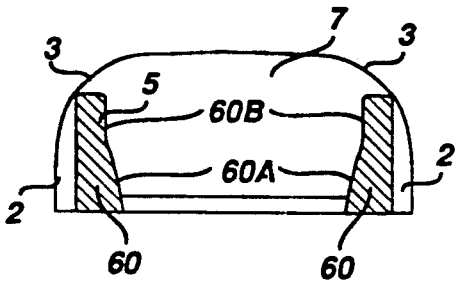

FIG. 3 Longitudinal section through a block according to experience.

Figure 4:
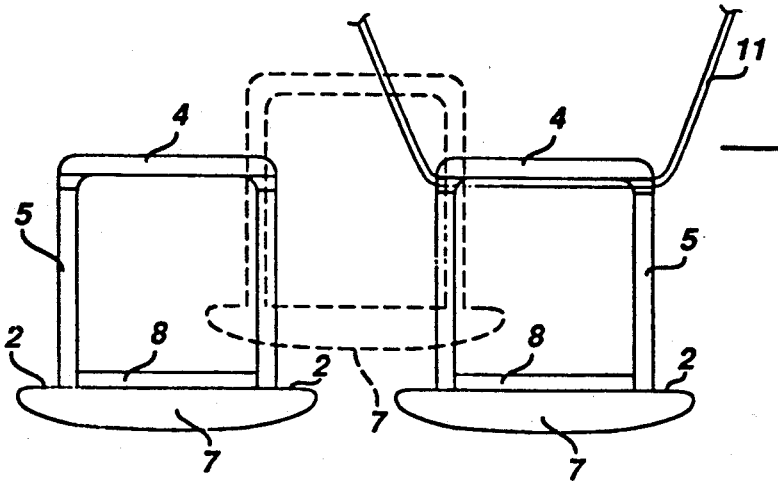

FIG. 4 Plan view extract of an embankment structure.

The oblique view according to FIG. 1 shows an embankment block with an approximately frame-shaped design. The front longitudinal wall 1 is shaped approximately like a shield. It projects on the top side and in the longitudinal direction, i.e. laterally, by approx. a wall thickness over the outer limits of the frame, with the projections 2 having curves 3 at corners and edges. A rear wall 4 and both transverse walls 5 jointly form, with the front wall, an approximately rectangular to square frame. The corners formed by the four walls are both rounded on the outside and on the inside. Underneath, recesses 9 are disposed on the transverse walls, which recesses are provided for trouble-free mounting by means of mounting forks or the like, and permit the engagement of the fork prongs. In the corner portion between the transverse walls and the rear wall, slots 10 are formed on the top side to permit the advantageous insertion of anchor bands or the like.

FIG. 2 as cross-section through a block according to the invention (section transverse to the embankment wall) shows the profile of the front wall 1 and the rear wall 4. On the front wall can be seen the topside projection and the formed curves 3 of the longitudinal edges. The cross-section of the longitudinal-side front wall shows that the inside, or back, face is generally flat with a concave projection 8 projecting inwardly from the lower portion of the back face, and that the outside or front face is curved with the curve 3 becoming more pronounced near the top edge the projection 8, serves to support the filling soil in the interior of the block. The rear wall 4 shows clearly in the profile a trapezoid which is slope to a greater extent in the lower portion 6. This means that the rear wall 4 is a shaped in two steps. The slope of the inside wall of the lower second step 6A is greater than the slope of the inside wall of the upper first step 6B. The same applies to the slope of the two transverse walls 5. The transverse wall 5 to be seen in elevation exhibits on the underside recesses 9 and on the top side in the connection portion to the rear wall a slot 10.

In FIG. 3 (section parallel to the embankment wall plane) the two transverse walls 5 appear in profile, the front wall 1 can be seen in rear view. The sections through the transverse walls show the trapezoidal profile which is developed more strongly on the inside in the lower portion 60 than at the top and thus likewise forms 2 steps 60 A and 60 B. Outside the transverse walls the projections 2 of the front wall appear in the longitudinal direction of the same. The upper corners of the front wall are formed by curves 3.

The plan view extract as per FIG. 4 of an embankment wall shows two blocks according to the invention of one row beside each other and a block of the row arranged above it set back in-between (shown in broken lines). This illustrates that the projections 2 of the front walls 1 reduce the opening of the building gap between the blocks and thus produce a protective niche 7. In this plan view it is also schematically shown that an anchor band loop 11 runs through the slots 10 shaped for it and interacts frictionally connected to the embankment block.

I claim:

1. An embankment block comprising a front longitudinal wall, two side transverse walls and a rear wall, each of said walls having a thickness, a top, a bottom and two sides; said walls forming a frame with an outline generally in the shape of a rectangle for the construction of embankment structures on which plants can be planted;

said front longitudinal wall being in the shape of a shield; wherein said top and each of said sides of said front longitudinal wall project above and to the side of each transverse wall by about said thickness of said walls;

said rear wall and each of said side transverse walls have a generally upright outside face and a sloped inside face forming a generally trapezoidal cross-section that is wider towards said bottom of said rear and transverse walls; and wherein said trapezoidal cross-section has a first and a second step; said second step being located toward said bottom of said rear and side walls and said inside face of said second step being more markedly sloped than said inside face of said first step.

2. An embankment block as claimed in claim 1, wherein each of said transverse walls have slot means located on said top near said side closest to said rear wall; and an anchor band means inserted in said slot means for anchoring said embankment block to a slope or other support.

3. An embankment block as claimed in claim 1, wherein said front longitudinal wall has an outside and an inside face; said outside face having a convex curvature which is more pronounced near said to of said wall, and said inside face being generally flat and having a concave projection near said bottom, projecting away from said inside face.

4. An embankment block comprising a front longitudinal wall, two side transverse walls and a rear wall, each of said walls having a thickness, a top, a bottom and two sides; said walls forming a frame with an outline generally in the shape of a rectangle for the construction of embankment structures on which plants can be planted;

said front longitudinal wall being in the shape of a shield, wherein said top and each of said sides of said front longitudinal wall project above and to the side of each transverse wall by about said thickness of said walls;

said rear wall and each of said side transverse walls have a generally upright outside face and a sloped inside face forming a generally trapezoidal cross-section that is wider towards said bottom of said rear and transverse walls;

said side transverse walls each have a slot means located on said top near said side closest to said rear wall; and an anchor band means inserted in said slot means, for anchoring said embankment block to a slope or other support.

5. An embankment block as claimed in claim 4 wherein said front longitudinal wall has an outside and an inside face; said outside face having a convex curvature which is more pronounced near said top of said wall, and said inside face being generally flat and having a concave projection near said bottom which projects away from said inside face.

6. An embankment block as claimed in claim 4, wherein said trapezoidal cross-section of said transverse and rear walls has a first and a second step; said second step being located toward said bottom of said walls; and said inside face of said second step being more markedly sloped than said inside face of said first step.

* * * * *